US005499890A

United States Patent [19]

Kishi

[11] Patent Number: 5,499,890

[45] Date of Patent: Mar. 19, 1996

[54] TRENCH SHORING DEVICE WITH LOCKING MECHANISM

[75] Inventor: Mitsuhiro Kishi, Tokyo, Japan

[73] Assignee: Americ Corporation, Elk Grove Village, Ill.

[21] Appl. No.: 277,488

[22] Filed: Jul. 8, 1994

[51] Int. Cl.[6] ..... E02D 17/04

[52] U.S. Cl. ..... 405/282; 92/18; 248/354.1

[58] Field of Search ..... 405/282, 283, 405/284, 290; 248/351, 354.1, 354.6; 92/18, 165 PR

[56] References Cited

U.S. PATENT DOCUMENTS

| | | | |
|---|---|---|---|
| 891,897 | 6/1908 | Astrom . | |
| 2,372,196 | 3/1945 | Grime . | |
| 2,408,181 | 9/1946 | Simonton . | |
| 2,922,283 | 1/1960 | Porter | 405/283 |
| 3,251,278 | 5/1966 | Royster | 92/18 |
| 3,321,182 | 5/1967 | Elenburg . | |
| 3,335,573 | 8/1967 | Ward . | |
| 3,347,049 | 10/1967 | Faltersack et al. . | |
| 3,470,699 | 10/1969 | Cox | 405/282 |
| 3,851,856 | 12/1974 | Berg . | |
| 3,905,279 | 9/1975 | Yadon . | |
| 4,130,205 | 12/1978 | Luthi | 92/165 PR X |
| 4,247,082 | 1/1981 | Sjölung . | |
| 4,449,734 | 5/1984 | Cory . | |
| 4,787,781 | 11/1988 | Bradberry | 405/282 |

FOREIGN PATENT DOCUMENTS

| | | | |
|---|---|---|---|
| 506440 | 10/1951 | Belgium | 248/354.6 |
| 1551170 | 12/1968 | France | 248/354.6 |
| 1204025 | 10/1965 | Germany | 92/165 PR |
| 946631 | 1/1964 | United Kingdom | 405/290 |
| 1603025 | 11/1981 | United Kingdom | 405/290 |
| 2209549 | 5/1989 | United Kingdom | 405/290 |

*Primary Examiner*—John A. Ricci
*Attorney, Agent, or Firm*—Wallenstein & Wagner Ltd.

[57] ABSTRACT

There is disclosed a shoring device for holding shoring boards against the walls of a trench. The shoring device is equipped with a locking mechanism to lock the device in an extended position in order to prevent the trench walls from collapsing. The shoring device includes a cylinder, a piston, and a piston rod with a rectangular cross-sectional geometry. The cylinder has an inlet for introducing a hydraulic fluid which upon entry into the cylinder causes the piston to slide within the cylinder, and the elongated piston rod to extend radially outwardly from the cylinder. In this extended position, the shoring device holds the shoring boards tightly against the walls of the trench. Upon retraction of the piston rod back into the cylinder, a cylinder end cap acts as a scraper, removing dirt and other particles from the surface of the rectangular piston rod.

3 Claims, 2 Drawing Sheets

TRENCH SHORING DEVICE WITH LOCKING MECHANISM

TECHNICAL FIELD

The present invention relates to a hydraulic trench shoring device with a locking mechanism for use in shoring the walls of a trench, ditch, or the like.

BACKGROUND OF THE INVENTION

In the construction and engineering fields it is common practice to dig trenches to lay water and sewer pipes, foundations, cables or the like. Typically, these trenches can be rather deep and require the physical entry of personnel who are installing the sewer pipe, foundation, cable or the like. To prevent cave-in or collapse of a freshly dug trench, the side walls of the trench are lined with shoring boards such as plywood or a similar material and then supported using what is commonly known in the industry as a trench brace or shoring jack. The shoring jack must be capable of extending to hold the shoring boards securely against the walls of the trench, and then locking in the extended position in order to prevent the shoring walls from collapsing.

Conventional shoring devices of this type include a cylinder and piston which form a hydraulically extendable actuator. The piston is connected to a elongated spherical piston rod which is reciprocal within the cylinder. The cylinder in turn is fitted with a hose for introducing hydraulic fluid into the cylinder thereby forcing the piston to extend relative to the cylinder.

In the past, shoring devices have been equipped with external mechanical locking means which consisted of a round threaded piston rod and a nut. The nut was threadedly connected to the piston rod and engaged the cylinder thus preventing contraction of the piston rod with respect to the cylinder. Such devices are shown in U.S. Pat. Nos. 891,897, 2,408,181, 3,905,279, and 4,787,781.

Another such shoring device utilized an internal mechanical locking means which consisted of a round threaded piston rod coaxially surrounded by a tubular sleeve. The tubular sleeve included an annular member provided with a male thread on the outer surface and a female thread on the inner surface. A nut cooperated with the outer surface of the annular member and acted to secure the threaded piston rod. Examples of this type of shoring device are found in U.S. Pat. Nos. 4,247,082 and 4,449,734.

However, in shoring devices of the type mentioned above, the threaded portion of the extendable piston rod collects dirt and other foreign particles which, upon reciprocating back into the cylinder, jeopardizes the integrity of the hydraulic seals. It is particularly this problem, among other things, that the present invention addresses.

SUMMARY OF THE INVENTION

The present invention provides a shoring device for holding shoring boards against the walls of a trench. The trench shoring device is equipped with a locking mechanism to lock the device in an extended position in order to prevent the trench walls from collapsing. One such device includes a cylinder having an open end and a closed end, and a piston connected to an elongated piston rod. The piston is reciprocal within the cylinder and the elongated piston rod extends radially outwardly from the open end of the cylinder. The elongated piston rod has a rectangular cross-sectional geometry with a relatively smooth outer surface. It is not believed that prior art shoring devices employ rectangular, smooth-surfaced piston rods. A cylinder end cap with a square opening fits over and forms a slidable seal with the piston rod, covering the open end of the cylinder. The cylinder is equipped with means for introducing a hydraulic fluid which upon entry into the cylinder causes the piston to slide within the cylinder and the elongated piston rod to extend radially outwardly from the opening in the cylinder cap. As the piston rod reciprocates back into the cylinder, the edges of the square opening in the cylinder end cap act as a scraper, removing dirt and other particles from the surface of the rectangular piston rod, thus preserving the integrity of the hydraulic seals within the cylinder.

The cylinder is equipped with a locking mechanism which may either hydraulically or mechanically actuate to effectively lock the piston rod in an extended operative position thus preventing the trench walls from collapsing, and also preventing the piston rod from retracting in the event that the hydraulic pressure within the cylinder is removed or fails. Other advantages and aspects of the present invention will become apparent upon reading the following description of the drawings and detailed description of the invention.

BRIEF DESCRIPTION OF THE DRAWINGS

A better understanding of the present invention will be had upon reference to the following detailed description and accompanying drawings, wherein.

DETAILED DESCRIPTION

Figure 1:
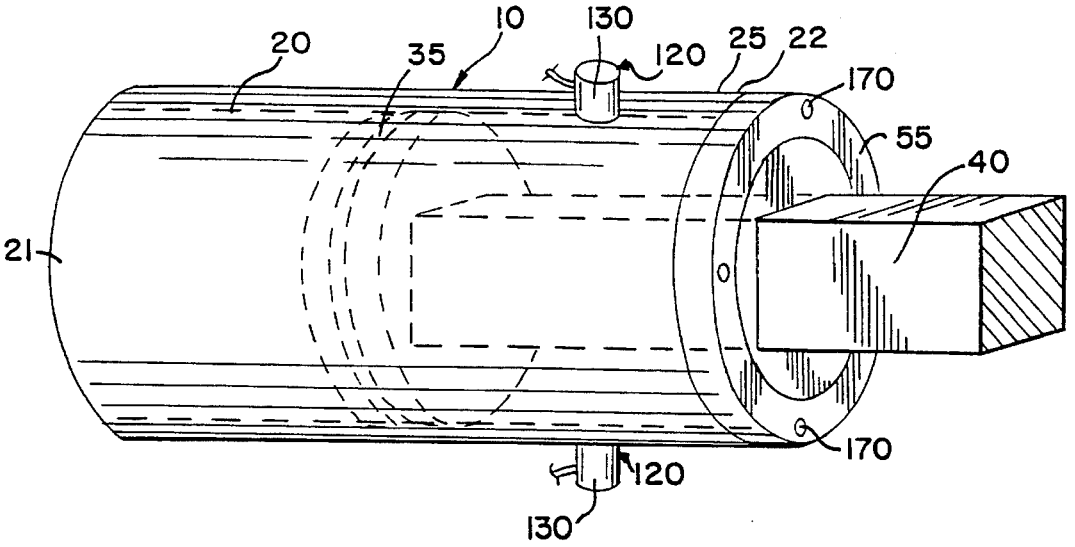
FIG. 1 is a perspective view of a trench shoring device with locking mechanism shown in phantom line and the elongated piston rod partially extended.

While this invention is susceptible of embodiment in many different forms, there is shown in the drawings and will herein be described in detail preferred embodiments of the invention with the understanding that the present disclosure is to be considered as an exemplification of the principles of the invention to the embodiments illustrated.

Figure 2:
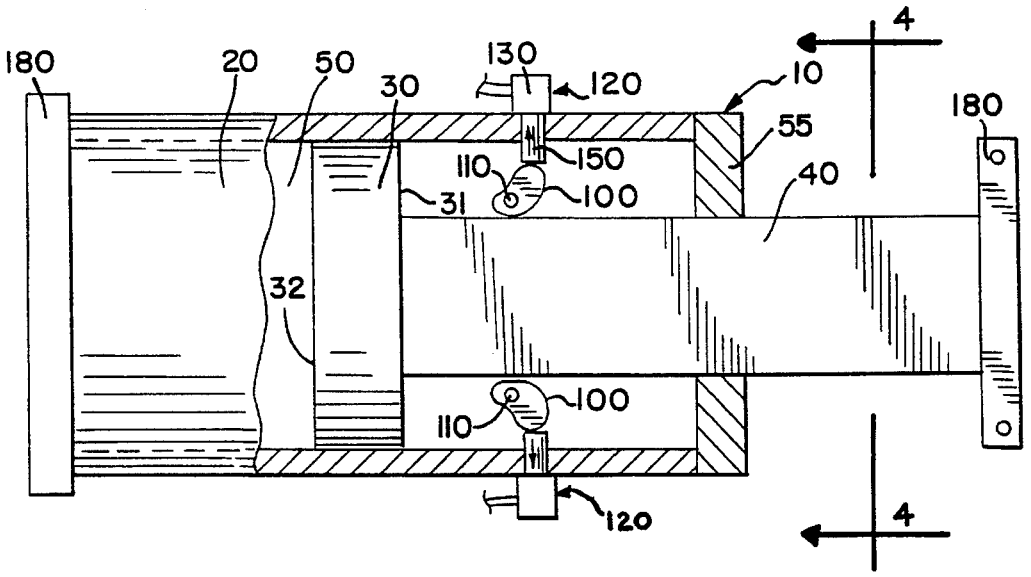
FIG. 2 is a sectional view with a portion of the cylinder broken away showing the elongated piston rod partially extended.
Figure 3:
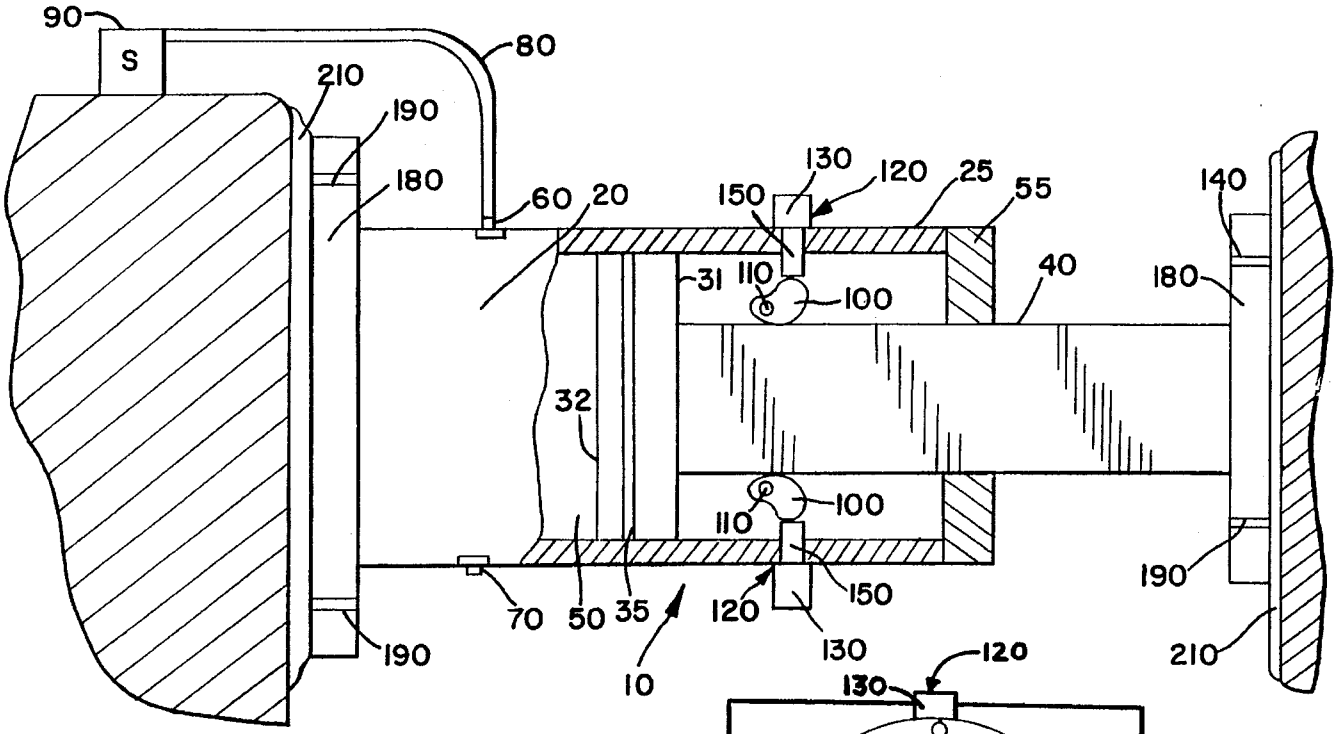
FIG. 3 is a side elevation view with a portion of the cylinder broken away showing the trench shoring device with locking mechanism in use in a trench; and, FIG. 4 is a cross-sectional view taken approximately along line 4—4 of FIG. 2 and looking in the direction of the arrows.

FIGS. 1, 2, and 3 disclose a trench shoring device 10 according to the present invention. The trench shoring device generally comprises a cylinder 20, a piston 30, and an elongated piston rod 40. The cylinder 20 has a closed end 21 and an initially open end 22. The piston 30 is provided with a conventional piston seal 35, and has a top side 31 and a bottom side 32. The piston 30 is reciprocally located within the cylinder 20. The bottom side 32 of the piston 30 forms a pressure chamber 50 with the closed end 21 of the cylinder 20. The elongated piston rod 40 has a rectangular cross-sectional geometry and is connected to the top side 31 of the piston 30 at one end, and extends radially outwardly through the initially open end 22 of the cylinder 20 at the opposite end. A cylinder end cap 55 having a center portion removed to define an opening, engages and forms a slidable seal with the elongated piston rod 40. The cylinder end cap 55 is attached to the cross- sectional face of the cylinder wall thus closing the initially open end 22 of the cylinder 20.

As illustrated in FIG. 3, the cylinder 20 is equipped with an inlet port 60 and an outlet port 70. A hose 80 connects the inlet port 60 with a source 90 of hydraulic fluid at the ground level above the trench. Hydraulic fluid is supplied from the surface level to the cylinder 20 by way of the hose 80.

The cylinder 20 is also equipped with means for locking the elongated piston rod 40 in an extended position relative to the cylinder 20. A pair of camming lobes 100 are positioned inside the cylinder 20, and on opposite sides of the elongated piston rod 40. Each camming lobe 100 is rotatably mounted by a securing pin 110. Adjacent each camming lobe 100 is a hydraulic or mechanical actuator 120. FIGS. 1 and 2 illustrate the hydraulic embodiment of the actuator 120. In this embodiment, the hydraulic actuators 120 each consist of a cylinder 130, a piston (not shown), and elongated piston rod 150. The cylinders 130 are connected to individual hydraulic fluid sources and operate in the same manner as cylinder 20, piston 30, and elongated piston rod 40 which is explained in detail below.

Figure 4:
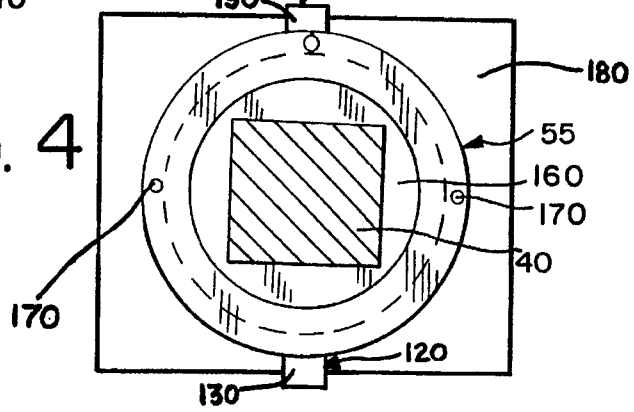

With reference now to FIG. 4, the cylinder end cap 55 is made from a rigid plastic or Nylon material and is provided with a center portion 160 which has a portion removed to define an opening. The center portion 160 of the cylinder end cap 55 engages and forms a slidable seal with the elongated piston rod 40. The center portion 160 acts as a scraper, removing dirt and other particles from the surface of the elongated piston rod 40 as it reciprocates back into the cylinder 20. Unlike prior trench shoring devices, this prevents dirt from entering the cylinder and destroying the hydraulic seals. The cylinder end cap 55 is fastened to the cylinder 20 and closes the initially open end 22 of the cylinder 20. In one embodiment, the cylinder end cap 55 is fastened to the cylinder 20 by a plurality of bolts 170. In another embodiment (not shown), the outside of the cylinder wall 25 is threaded adjacent the initially open end 22 of the cylinder 20. The cylinder end cap 55 is also threaded, and threadedly engages the cylinder wall 25 for ease of removal.

FIG. 2 shows the trench shoring device 10 provided with a pair of supporting plates 180. The first supporting plate 180 is attached to the closed end 22 of the cylinder 20, and the second bearing plate 180 is attached to the end of the elongated piston rod 40 which extends radially outwardly from the cylinder 20.

FIG. 3 illustrates the trench shoring device 10 engaging the shoring boards 210 which line a trench to be shored. In the preferred embodiment, both supporting plates 180 have apertures 190 which receive securing screws for engagement with a shoring board 210 to prevent the shoring device 10 from slipping during use. In operation, the trench shoring device 10 is initially secured to a single shoring board 210 by inserting screws through the apertures 190 in the supporting plate 180 which is attached to the closed end 22 of the cylinder 20. Hydraulic fluid from the source 90 is then introduced into the cylinder 20 through the hose 80 and the inlet port 60. As the hydraulic fluid fills the pressure chamber 50, the pressure increases and forces the piston 30 and the elongated piston rod 40 to move. The piston 30 and the elongated piston rod 40 actuate until the second supporting plate 180 contacts the shoring board 210 on the opposite side of the trench.

In one embodiment, the locking mechanism can now be initiated by opening a valve (not shown) introducing hydraulic fluid into each cylinder 130 of the hydraulic actuators 120. As the pressure in each cylinder 130 increases, each piston moves within its respective cylinder 130, and the connected elongated piston rods 150 extend outwardly from each cylinder 130.

The piston rods 150 exert a force on the camming lobes 100 causing them to rotate about securing pins 110. As the camming lobes 100 rotate about securing pins 110, they exert force on opposing sides of elongated piston rod 40 thus locking it in its operable position. Even in this locked position elongated piston rod 40 is permitted to extend as the camming lobes 100 will rotate about their respective securing pin 110. However, elongated piston rod 40 cannot reverse its direction as any movement in the opposite direction causes camming lobes 100 to rotate and exert a force on opposing sides of elongated piston rod 40 thus preventing its retraction. When actuated, this effectively locks the elongated piston rod 40 in the extended position and prevents collapse in the event that hydraulic pressure in pressure chamber 50 is lost.

While the specific embodiments have been illustrated and described, numerous modifications come to mind without significantly departing from the spirit of the invention and the scope of protection is only limited by the scope of the accompanying Claims.

I claim:

1. A hydraulic trench shoring device comprising:

a cylinder having an initially open end and a closed end;

a piston having a top side and a bottom side, the piston being reciprocal within the cylinder, and the bottom side of the piston forming a pressure chamber with the closed end of the cylinder;

an elongated piston rod having two ends, the first end connected to the top side of the piston and the second end extending radially outwardly from the open end of the cylinder, the elongated piston rod having a generally square cross-sectional geometry;

a cylinder end cap having a portion removed to define an opening, the cylinder cap engaging and forming a slidable seal with the elongated piston rod, and enclosing the open end of the cylinder;

means for introducing hydraulic fluid into the pressure chamber thereby causing the piston to slide within the cylinder and the elongated piston rod to extend radially outwardly from the opening in the cylinder cap; and, means for locking the elongated piston in an extended position relative to the cylinder and preventing the retraction of the elongated piston rod back into the cylinder, said locking means including:

a pair of camming lobes positioned on opposite sides of the elongated piston rod within the cylinder;

a set of securing pins, each camming lobe being pivotable about a securing pin;

and, means for exerting a force on each camming lobe such that the camming lobes pivot about the securing pins and make contact with opposing sides of the elongated piston rod thus securing the elongated piston rod in its operable position.

2. The device of claim 1, wherein the cylinder end cap includes means for scraping dirt and other particles from the elongated piston rod as it reciprocates back into the cylinder.

3. The device of claim 1, wherein the hydraulic trench shoring device further comprises two supporting plates, the first supporting plate attached to the closed end of the cylinder, and the second supporting plate attached to the end of the elongated piston rod which extends radially outwardly from the cylinder.

* * * * *